United States Patent [19]

Yoshioka

[11] Patent Number: 4,741,640

[45] Date of Patent: May 3, 1988

[54] INK RIBBON CARTRIDGE OF A PRINTING MACHINE

[75] Inventor: Satoru Yoshioka, Kamakura, Japan

[73] Assignee: Ricoh Company Ltd., Japan

[21] Appl. No.: 933,305

[22] Filed: Nov. 20, 1986

Related U.S. Application Data

[63] Continuation of Ser. No. 450,262, Dec. 16, 1982, abandoned.

[30] Foreign Application Priority Data

Dec. 16, 1981 [JP] Japan ..... 56-187623[U]

[51] Int. Cl.[4] ..... B41J 32/02; B41J 32/28

[52] U.S. Cl. ..... 400/208; 400/196.1; 400/234

[58] Field of Search ..... 400/234, 196.1

[56] References Cited

U.S. PATENT DOCUMENTS

| | | | |
|---|---|---|---|
| 3,814,231 | 6/1974 | Cappotto | 400/196.1 |
| 3,974,906 | 8/1976 | Lee et al. | 400/196.1 |
| 4,053,042 | 10/1977 | Hess | 400/234 |
| 4,091,914 | 5/1978 | Stipanuk | 400/196.1 |
| 4,232,976 | 11/1980 | Bernardis et al. | 400/196.1 |
| 4,293,234 | 8/1979 | Yonkers et al. | 400/196.1 |
| 4,325,645 | 4/1982 | Miyajima et al. | 400/196.1 |
| 4,364,678 | 12/1982 | Ogan | 400/234 |
| 4,383,774 | 5/1983 | Yonkers | 400/234 |
| 4,397,574 | 3/1983 | Wojdyla | 400/234 |
| 4,469,457 | 9/1984 | Chida et al. | 400/196.1 |
| 4,630,948 | 12/1986 | Karns | 400/234 |

FOREIGN PATENT DOCUMENTS

| | | | |
|---|---|---|---|
| 2077227 | 12/1981 | Japan | 400/196.1 |

*Primary Examiner*—William Pieprz

*Attorney, Agent, or Firm*—Guy W. Shoup

[57] ABSTRACT

An ink ribbon cartridge for use in a typewriter, printer and the like includes a driving mechanism to move a strip of ink ribbon out of the cartridge through a supply port and again into the cartridge through a take-up port and a deterrent mechanism to impart a back tension to the ink ribbon when pulled toward the take-up port from the supply port. The deterrent mechanism includes a guide post and a leaf spring whose forward end is pressed against the guide post with the ink ribbon sandwiched therebetween. The forward end of the leaf spring is provided with oppositely extending side projections which are inserted into the relief holes provided in the top and bottom walls of the cartridge. More preferably, the guide post extends from the bottom wall and extends into the relief hole of the top wall.

9 Claims, 4 Drawing Sheets

INK RIBBON CARTRIDGE OF A PRINTING MACHINE

This is a continuation application from application Ser. No. 450,262 filed Dec. 16, 1982 now abandoned.

BACKGROUND OF THE INVENTION

1. Field of the Invention

This invention relates to an ink ribbon cartridge for use in typewriters, printers and the like and in particular to such an ink ribbon cartridge detachably mountable in typewriters, printers and the like and having a supply port and a take-up port wherein an ink ribbon is intermittently advamced in tension from the supply port to the take-up port as the printing operation proceeds.

2. Description of the Prior Art

A typical prior art ink ribbon cartridge is illustrated in FIG. 1 and it generally includes a bottom case 1 having a bottom wall and a side wall integrally formed along the periphery of the bottom wall and a top wall 2 which is placed on top of the side wall of the bottom case 1 to define a space therebetween in which ink ribbon 3 is stored. As shown, the cartridge is provided with a supply port 4 and a take-up port 5 spaced apart over a predetermined distance from the supply port 4 thereby defining a printing section therebetween. Thus, when printing operation is in progress, the ink ribbon 3 is fed outside to the printing section thrOugh the supply port 4 and then led into the cartridge again through the take-up port 5 to be stored therein by means of a driving mechanism (not shown). As is well-known in the art, when the cartridge is mounted in a printing machine, a printing head provided with a printing hammer and a type carrier carrying thereon a plurality of types is located in the space defined between the supply and take-up ports 4, 5 of the cartridge, so that a selected type is impacted on the ink ribbon against paper placed around a platen roller of the printing machine by the printing hammer to form a desired imprint on the paper. Thus, as the printing operation proceeds, the ink ribbon is advanced from the supply port 4 to the take-up port 5 through the printing section defined therebetween intermittently as well as incrementally.

In order to allow to form proper imprints by having the printing hammer impact on the lead-out portion of the ink ribbon 3, typically the so-called "back tension" is desired to be imparted to the ink ribbon 3 so that the ink ribbon 3 may be intermittently advanced from the supply port 4 to the take-up port 5 in tension. Accordingly, in a typical prior art ink ribbon catridge, a deterrent mechanism is provided to apply back tension to the ink ribbon 3. That is, as shown in FIG. 1, such a prior art deterrent mechanism is comprised of a ribbon guide post 7 formed at one end of a ribbon guide rib 6 which is integrally provided with the bottom case 1 as extending toward the supply port 4, and a leaf spring 8 whose base end is inserted into a recess formed in the bottom case and whose forward end is pressed against the ribbon guide post 7 with the ink ribbon 3 sandwiched therebetween. As a result, a deterrent force is imparted to the ink ribbon 3 as mainly determined by the pressing force applied by the leaf spring 8, so that the ribbon 3 may be kept in tension as it is pulled toward the take-up port 5 through the supply port 4.

However, in such a prior art deterrent mechanism, the ribbon guide post 7 projecting upwardly from the bottom wall of the case 1 into the space defined between the bottom and top walls must be so shaped that it is slightly convergent from its base to its top because of manufacturing constraints, and yet a gap must be provided between the top wall 2 and the top of the post 7 by taking into account reasonable manufacturing tolerances. Such being the case, it has been observed more often than not that the ribbon 3 at least partly gets into the gap defined between the top case 2 and the top of the guide post 7 as shown in FIG. 2*a*. Alternatively, the ribbon 3 has also been found to move into the gap defined between the top case 2 and the leaf spring 8, as shown in FIG. 2*b*, or into the gap defined between the bottom case 1 and the leaf spring 8, as shown in FIG. 2*c*. This is disadvantageous because the level of "back tension" fluctuates and the ink ribbon 3 cannot be maintained properly in tension thereby producing printed characters of poor quality.

SUMMARY OF THE INVENTION

It is therefore a primary object of the present invention to provide an improved ink ribbon cartridge.

Another object of the present invention is to provide an ink ribbon cartridge capable of maintaining its ink ribbon properly in tension at all times.

A further object of the present invention is to provide an ink ribbon cartridge which allows to produce imprints of excellent quality.

A still further object of the present invention is to provide an improved ink ribbon catridge which is relatively simple in structure and thus easy to manufacture.

Other objects, advantages and novel features of the present invention will become apparent from the following detailed description of the invention when considered in conjunction with the accompanying drawings.

DESCRIPTION OF THE PREFERRED EMBODIMENTS

Figure 1:
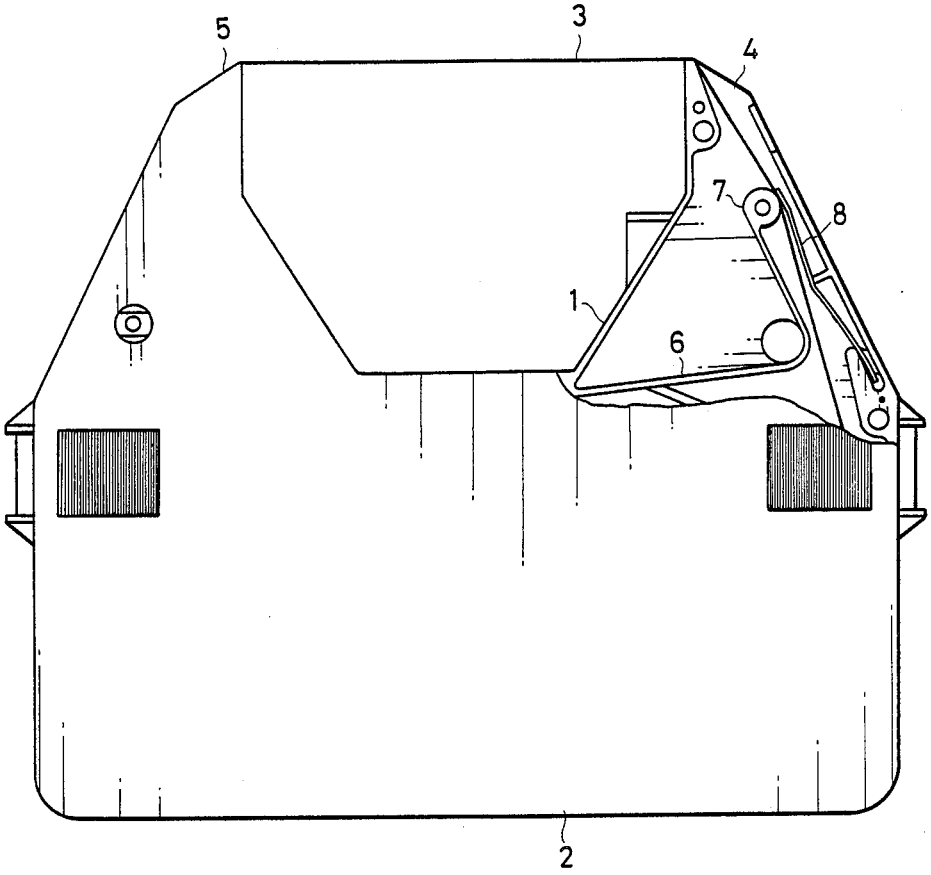
FIG.1 PRIOR ART
FIG. 1 is a plan view showing a typical prior art ink ribbon cartridge with a part of its top wall removed to show the inside structure.
Figure 2A:
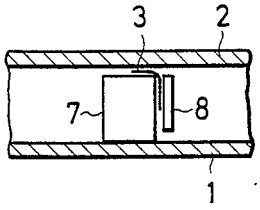
FIG. 2a PRIOR ART
FIGS. 2*a* through 2*c* are schematic illustrations showing several cases in which the ink ribbon 3 becomes improperly positioned in the prior art deterrent mechanism formed in the ink ribbon cartridge of FIG. 1.
Figure 2B:
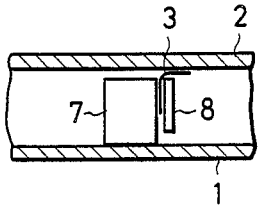
FIG. 2b PRIOR ART
Figure 2C:
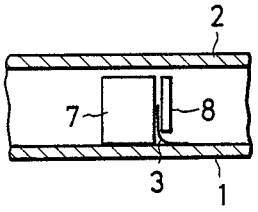
FIG. 2c PRIOR ART
Figure 3:
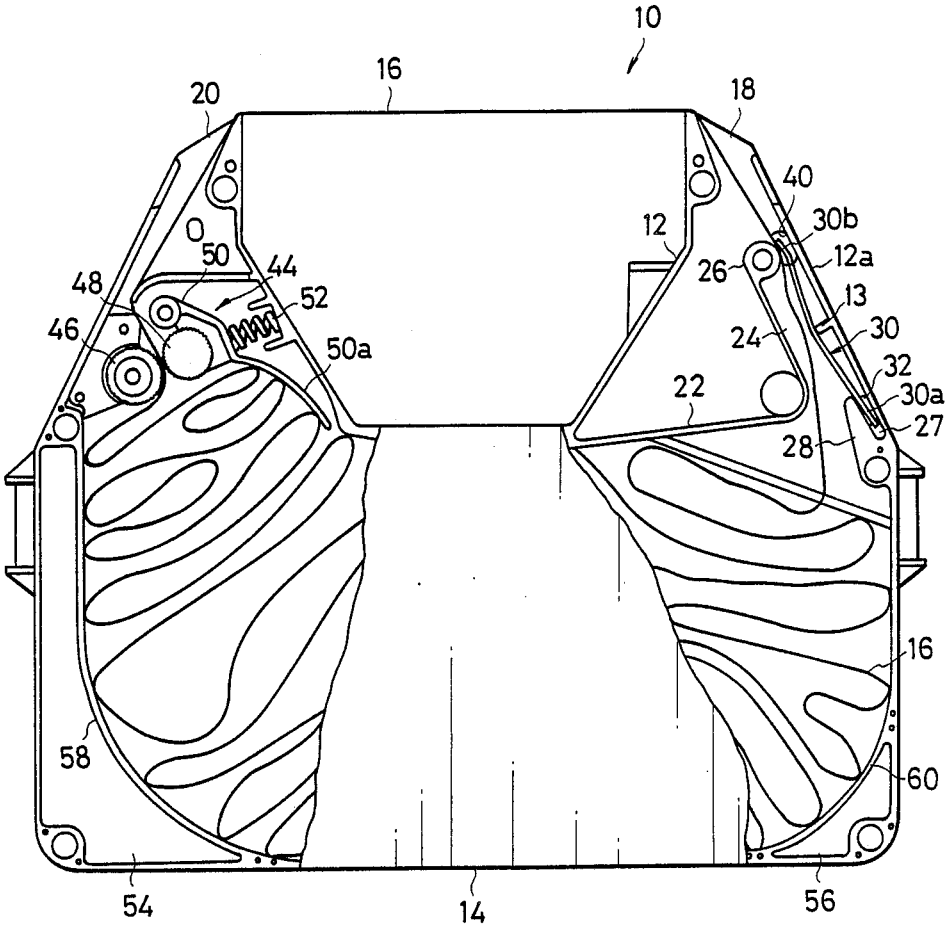
FIG. 3 is a plan view showing the ink ribbon cartridge embodying the present invention with the top wall partly removed to show the inside structure.

Referring now to FIG. 3, there is shown one embodiment of the present ink ribbon cartridge 10 with its top wall 14 partly removed to show the inside structure. The overall structure of the cartridge 10 is well-known in the art, and it is detachably mounted in a predetermined position of a typewriter, printer or the like to be used for printing. As shown, the cartridge 10 includes a bottom case 12 having a bottom wall and a side wall formed along the periphery of the bottom wall and a top wall 14 which is fixedly attached to top of the side wall of the bottom case 12 to define a space therebetween in which a strip of ink ribbon 16 is stored. One example of such a strip of ink ribbon 16 is a fabric ink ribbon comprised of a fabric material impregnated with ink, so that it may be presented for use repetitively. Another example is a film ink ribbon comprised of a strip of film on which a layer of ink is formed. Such a film ink ribbon may be of the type of one time use or of the type of multiple use. In the embodiment shown in FIG. 3, the ink ribbon 16 used is of the fabric type, though the present invention would not be limited thereto.

The cartridge 10 is provided with an ink ribbon supply port 18 through which the ink ribbon 16 is lead outside, and the cartridge 10 is also provided with a take-up port 20 which is spaced apart over a predetermined distance from the supply port 18 and through which the ink ribbon 16 once lead outside is again lead into the cartridge 10. That portion of the ink ribbon 16 extending between the supply and take-up ports 18, 20 is located at the printing position when the cartridge 10 is set in position in a typewriter or printer. Thus, when the cartridge 10 is mounted in a printing machine, the printing hammer and the type carrier or wheel of the printing machine are located between a pair of projecting sections of the cartridge 10 which are provided with the supply port 18 and the take-up port 20 at their forward ends, respectively. Thus, when in use, the printing hammer causes a selected type of the type carrier pressed against paper with the ink ribbon 16 sandwiched therebetween.

Figure 4:
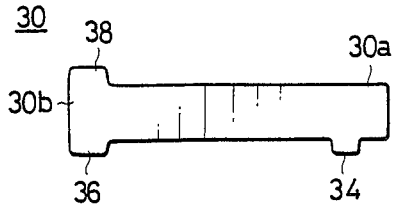
FIG. 4 is a front view of the leaf spring 30 forming a part of the improved deterrent mechanism of the ink ribbon cartridge of FIG. 3.

The bottom case 12 is integrally provided with an ink ribbon guide rib 22 a part of which extends generally in parallel with and in the vicinity of a side wall 12*a* of the bottom case 12 to define a guide passage 24 for guiding the movement of the ink ribbon 16 therebetween. At the forward end of the guide rib 22 is formed a guide post 26. A holding section 28 is provided at a part of the side wall 12*a* of the bottom case 12, and a recess 27 is formed in the holding section 28 opened toward the passage 24. A leaf spring 30 having the shape as shown in FIG. 4 is disposed extending along the guide passage 24, and the base end 30*a* of the leaf spring 30 is held by the holding section 28 by being inserted in the recess 27. It is to be noted that a hole 32 is provided in the bottom case 12 within the recess 27. On the other hand, as shown in FIG. 4, the leaf spring 30 has a side projection 34*a* at its base end 30*a*, so that the side projection 34*a* is loosely fitted into the hole 32, and thus the leaf spring 30 may be properly held in position.

The side wall 12*a* of the bottom case 12 is also provided with a protuberance 13" extending into the guide passage 24 over a predetermined distance at the location spaced apart from the holding section 28 and approximately at the midway along the length of the leaf spring 30. Accordingly, when the leaf spring 30 is set in position as shown in FIG. 3, it is slightly bent as supported at three points: recess 27, protuberance 13" and guide post 26, and thus the forward end 30*b* of the leaf spring 30 keeps the ink ribbon 16 pressed against the guide post 26 at a predetermined pressure.

Figure 5:
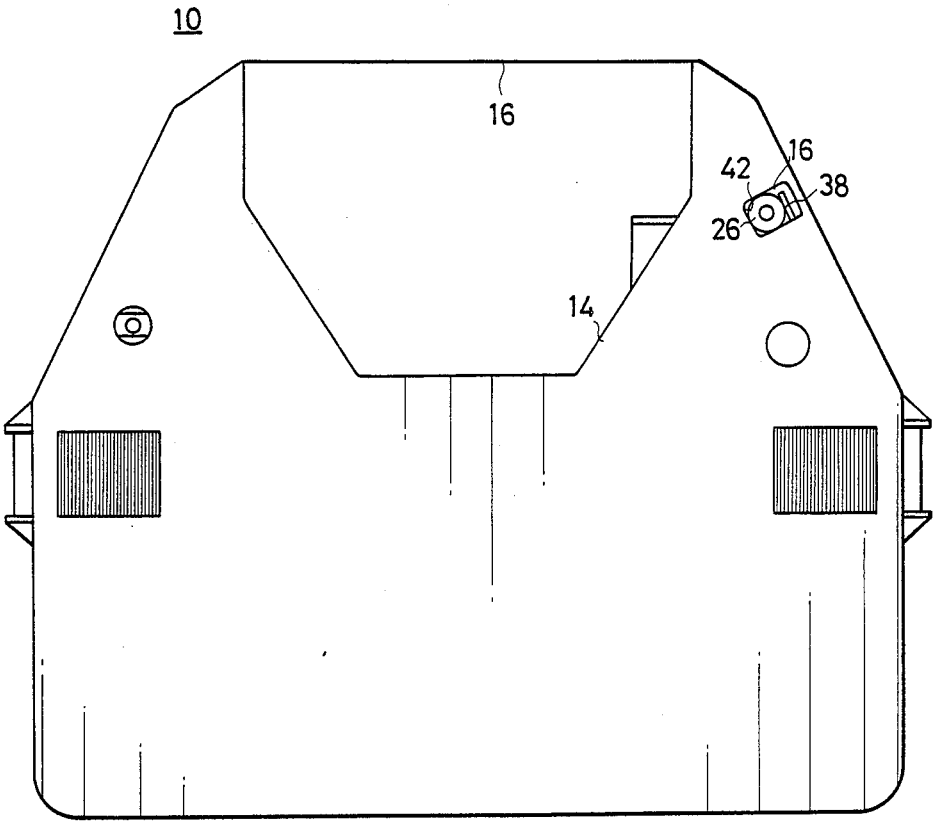
FIG. 5 is a plan view of the ink ribbon cartridge of FIG. 3 showing the complete structure of the top wall.

As shown in FIG. 4, a pair of side projections 36 and 38 are provided at the forward end of the leaf spring 30 so as to extend in opposite directions perpendicular to the lengthwise direction of the leaf spring 30. On the other hand, as shown in FIG. 3, a relief hole 40 is provided in the bottom case 12 adjacent to the guide post 26, so that the bottom side projection 36 may be loosely fitted into the relief hole 40 when the spring 30 is placed in position. Furthermore, as shown in FIG. 5, the top case 14 is also provided with a relief hole 42 as generally opposed to the relief hole 40 of the bottom case 12. The relief hole 42 is large enough to receive therein not only the top side projection 38 of the leaf spring 30 but also the top end of the guide post 26.

Referring back to FIG. 3, a ribbon feed driving mechanism 44 is provided in the cartridge 10 at the side where the take-up port 20 is formed. The driving mechanism 44 includes a driving roller 46, which may be operatively coupled to the driving motor (not shown) of a printer when the cartridge 10 is mounted therein, and a counter roller 48 which is pressed against the driving roller 46 with the ink ribbon 16 sandwiched therebetween by means of a support member 50 which is pivoted to the bottom case 12 and urged toward the driving roller 46 by a coil spring 52. An arm 50*a* extends from the support member 50 generally along the side wall of the cartridge 10 so as to prevent the ink ribbon 16 lead into the cartridge 10 from being tangled and to guide the ink ribbon 16 further into the cartridge 10. Besides, curved ribs 58 and 60 are integrally provided at corners 54 and 56, respectively, of the bottom case 12 so that the ink ribbon 16 may be smoothly moved toward the guide passage 24 after having been pulled into the cartridge 10 as driven by the driving gear 46.

With the above-described structure, the ink ribbon 16 is intermittently pulled toward the take-up port 20 from the supply port 18 as driven by the driving roller 46 whereby a proper back tension may be imparted to the ink ribbon 16 extending between the supply and take-up ports 18, 20 since the forward end 30*b* of the leaf spring 30 is pressed against the post 26 with the ink ribbon 16 sandwiched therebetween. Importantly, in accordance with the present invention, the leaf spring 30 is so structured that the forward end 30*b* of the leaf spring 30 is provided with the pair of oppositely extending projections 36 and 38 which are respectively received in the relief hole 40 of the bottom wall 12 and the relief hole 42 of the top wall 14, and, furthermore, the guide post 26 is formed long enough to extend into the relief hole 42 of the top wall 14. Therefore, the ink ribbon 16 is completely prevented from riding over the post 26 or the forward end 30*b* of the leaf spring 30. Consequently, a proper back tension may be imparted to the ink ribbon 16 extending between the supply and take-up ports 18 and 20 at all times, which, in turn, allows imprints of excellent quality to be allowed whenever the printing operation is carried out using the present ink ribbon cartridge.

While the above provides a full and complete disclosure of the preferred embodiments of the present invention, various modifications may be employed without departing from the true spirit and scope of the invention. For example, a pad comrised of an elastic material may be provided on top of the guide post to eliminate the gap between the top case and the guide post instead of making a large relief hole and making the guide post long enough to extend into the large relief hole as described above. Therefore, the above description and illustration should not be construed as limiting the scope of the invention, which is defined by the appended claims.

What is claimed is:

1. An ink ribbon cartridge comprising:

a case including top, bottom and side walls to define a storing space for storing therein ink ribbon said case being provided with supply and take-up ports spaced apart from each other;

ribbon-moving means for moving said ink ribbon out of said space through said supply port and again into said space through said take-up port when driven externally; and tension-imparting means for imparting a tension to said ink ribbon when said ink ribbon is pulled toward said take-up port through said supply port by said ribbon-moving means, said tension-imparting means including a guide post provided in an ink ribbon guide passage leading to said supply port and integrally formed with said bottom wall with its upper portion extending into a first hole formed in said top wall thereby guiding movement of said ink ribbon partly around said guide post between surfaces of said top and bottom walls, said first hole being substantially larger than said guide post thereby providing a gap between said upper portion and at least part of the periphery of said hole, and urging means held to said case for urging said ink ribbon against said guide post with said ink ribbon sandwiched therebetween wherein said urging means includes a leaf spring having a forward end portion pressed against said guide post, said forward end portion being provided with at least an upper extending side projection which is received in said first hole of said top wall so as to extend beyond the surface of the top wall along with said upper portion of said guide post.

2. An ink ribbon cartridge of claim 1 wherein said forward end portion is provided with a pair of oppositely extending side projections which are respectively received in said first hole of said top wall and a second hole formed in said bottom wall so as to end beyond a distance between the surfaces of said top and bottom walls.

3. An ink ribbon cartridge of claim 2 further comprising a holding section including a recess for receiving therein a base end of said leaf spring which is opposite to said forward end.

4. An ink ribbon cartridge of claim 3 wherein said bottom wall is provided with a third hole located at said recess, and said leaf spring includes at the base end another side projection which is movably fitted into said third hole.

5. An ink ribbon cartridge of claim 1 wherein said ribbon moving means includes a driving roller which may be driven to rotate when connected to an external driving source when the cartridge set in position in a printer and a counter roller urged against said driving roller with said ink ribbon sandwiched therebetween.

6. An ink ribbon cartridge of claim 1 wherein said bottom wall is provided with a first guide rib which extends upright from the surface of said bottom wall and which has a guide portion extending partly in parallel with a predetermined portion of said side walls over a predetermined distance to said guide post thereby defining said guide passage in an elongated shape.

7. An ink ribbon cartridge of claim 6 wherein said first guide rib is intergral with said guide post.

8. An ink ribbon cartridge of claim 6 wherein said guide portion of said first guide rib extends substantially in parallel with said leaf spring.

9. An ink ribbon cartridge of claim 1 wherein said bottom wall is integrally formed with at least one second guide rib which is arcuate in shape and provided at a corner of said cartridge for smoothly guiding the movement of said ink ribbon within said space.

* * * * *